United States Patent [19]

Culling

[11] Patent Number: 4,873,055

[45] **Date of Patent: * Oct. 10, 1989**

[54] CORROSION RESISTANT FE-NI-CR ALLOY

[75] Inventor: John H. Culling, St. Louis, Mo.

[73] Assignee: Carondelet Foundry Company, St. Louis, Mo.

[ * ] Notice: The portion of the term of this patent subsequent to Jan. 3, 2006 has been disclaimed.

[21] Appl. No.: 287,839

[22] Filed: Dec. 20, 1988

[51] Int. Cl.[4] ..... C22C 30/00

[52] U.S. Cl. ..... 420/582

[58] Field of Search ..... 420/586.1, 587, 582

[56] References Cited

U.S. PATENT DOCUMENTS

| | | | |
|---|---|---|---|
| Re. 27,226 | 11/1971 | Moskowitz et al. | 420/582 |
| 2,185,987 | 1/1940 | Parsons, Jr. | 420/582 |
| 2,251,163 | 7/1941 | Payson | 420/49 |
| 2,423,665 | 7/1947 | Sullivan et al. | 420/49 |
| 2,553,330 | 5/1951 | Post et al. | 420/586.1 |
| 2,938,787 | 5/1960 | Boyd et al. | 420/442 |
| 3,008,822 | 11/1961 | Boyd et al. | 420/451 |
| 3,168,397 | 2/1965 | Scharfstein | 420/582 |
| 3,726,668 | 4/1973 | Bäumel et al. | 420/582 |
| 3,811,875 | 5/1974 | Goda, Jr. et al. | 420/582 |
| 4,012,227 | 3/1977 | Forbes Jones et al. | 420/586.1 |
| 4,141,767 | 2/1979 | Sudweeks et al. | 149/23 |
| 4,172,716 | 10/1979 | Abo et al. | 420/41 |
| 4,400,349 | 8/1983 | Kudo et al. | 420/582 |
| 4,421,557 | 12/1983 | Rossomme et al. | 420/40 |
| 4,795,610 | 1/1989 | Culling | 420/587 |

FOREIGN PATENT DOCUMENTS 58-210157 7/1983 Japan .

*Primary Examiner*—L. Dewayne Rutledge
*Assistant Examiner*—David W. Schumaker
*Attorney, Agent, or Firm*—Senniger, Powers, Leavitt and Roedel

[57] ABSTRACT

This invention relates to alloys resistant to corrosion, and especially resistant to corrosion caused by contact with hot sulfuric acid of over 98% concentration.

The alloys of the invention consist essentially by weight percentages of from about 19% to about 30% by weight Ni, from about 19% to about 27% by weight Cr, from about 0.3% to about 1.0% by weight Mo, from about 2.7% to 4.5% by weight Cu, from about 2.7% to about 4.7% by weight Mn, from about 2.45% to about 5.5% by weight Si, from about up to about 0.08% C by weight, and the balance essentially iron. The alloys may optionally contain up to 0.7% Cb partially replaced by up to 1% Ta, up to 0.6% W, up to 0.12% N and up to 0.8% Co, all by weight.

14 Claims, No Drawings

CORROSION RESISTANT FE-NI-CR ALLOY

This invention relates to alloys resistant to corrosion, and especially resistant to corrosion caused by contact with hot sulfuric acid of over 98% concentration.

BACKGROUND OF THE INVENTION

Sulfuric acid continues to be the largest volume inorganic acid in use today and is generally cosidered to be the most important industrial chemical. Many metallic and nonmetallic substances resist various concentrations of sulfuric acid either as relatively pure acid-water solutions or in combination with other acids, contaminating ions, dissolved gases or solid particulate matter. Also, the selection of a sulfuric-acid resistant material will often have to be altered depending upon whether the acid to be encountered will be a still liquid or in a condition of low or high velocity flow. Also, the corrosiveness of sulfuric acid depends very much upon temperature and concentration. Hot strong acid presents the greatest problem. This is true for oleum (up to 30% excess sulfur trioxide) as well.

While both cast and wrought alloys have been developed to handle various strengths of sulfuric acid, the wrought alloys are generally inferior to the best cast alloys in resistance to hot, concentrated acid. This situation results primarily because such cast alloys usually contain high levels of silicon. On the other hand, the casting alloys, because of their high levels of silicon, are quite difficult to weld and machine, let alone hot or cold form into items such as sheets or tubes.

Nevertheless, the use of silicon as an addition element remains attractive because of its wide availability and very low cost coupled with its pronounced tendency to improve the resistance of these alloys to hot, concentrated sulfuric acid. However, silicon tends to embrittle sulfuric acid resistant alloys when present in concentrations above about 2–2.5% by weight. The ductility and fabricability of such acid resistant alloys are also reduced by increasing the amount of Cr, Mo, Cb and even Ni, although Si has the most detrimental effect. Furthermore, the reduction in ductility from using various elements is cumulative.

One of the earliest prior art alloys said to be useful for applications requiring resistance to sulfuric acid is found in Payson, U.S. Pat. No. 2,251,163, which dealt with nominally Fe—12% Ni—24% Cr—2% Mo—1.2% Cu alloys but claimed ranges of 20 to 28% Cr, 0.5 to 5% Mo, 0.5 to 5% Cu, up to 1.25% Si and 10 to 16% Ni. Payson's alloys were low in both Si and Ni content and of very inferior corrosion resistance to sulfuric acid to today's standards.

Later, Sullivan U.S. Pat. No. 2,423,665, July, 1947, disclosed alloys nominally having an element content of Fe—28% Ni—20% Cr—1.7% Mo—2.5% Cu—2.5% Si—0.75% Mn, but claiming 27–30% Ni, 19–22% Cr, 0.5–2% Mo, 0.7–3.5% Si, 1.25–3.5% Cu and 0.5–1% Mn. The Sullivan patent places stress on the fact that Ni content is always greater than Cr content in that invention. Sullivan also states that it is preferred to keep Mn content close to the mean, or about 0.75%. Sullivan further states that reducing Mo content below 1% greatly increases the rate of corrosion of his alloys by sulfuric acid.

There have been many other attempts to develop alloys resistant to sulfuric acid, especially hot concentrated sulfuric acid, which have improved ductility but which retain their acid resistance. Parsons, U.S. Pat. No. 2,185,987, January, 1940, disclosed what has come to be known as Alloy 20, nominally Fe—25% Ni—20% Cr—2.5% Mo—3.3% Cu, for resistance to sulfuric acid. This alloy has undergone a few changes over the years, and Scharfstein, U.S. Pat. No. 3,168,397, February, 1965, disclosed a similar alloy now called 20Cb3, but with Ni content increased to 34% and the addition of Cb or Ti. Both of these alloys along with a number of similar highly-modified stainless steels are available in all of the wrought forms but are limited to use at 60°–65° C. with concentrated sulfuric acid.

Moskowitz et al, U.S. Re. 27,226, November 1971, is directed to alloys having broad ranges of Ni, Cr and Mn, and also provides for optional amounts of Si, Mo and Cu along with 0.25 to 0.45% S and up to 0.5% P. Aside from the fact that Si, Mo and Cu are optional, these sulfur contents are quite intolerable for hot sulfuric acid resistance, and phosphorus present over about 0.05% maximum lowers notch ductility in austenitic stainless steels and also tends to harden them considerably by a precipitation-hardening mechanism.

Goda, U.S. Pat. No. 3,811,875, May 1974, discloses alloys containing Ni, Cr, Mn and Cu and also requires 0.25 to 2% Al and 0.15 to 0.75% sulfur and selenium to improve machinability. Up to 3% Si and up to 3.5% Mo, are also allowed which makes both elements optional. Goda also states that all or part of the Mo may be replaced by W. The S and Se additions are the heart of the Goda invention and included to improve their free-machining properties. While they tend to do so, they are detrimental to weldability, formability and corrosion resistance.

In U.S. Pat. No. 2,938 787, May 1960, Boyd, et al., disclosed a casting alloy of excellent resistance for its time to hot concentrated sulfuric acid. It is still marketed under the name of Illium B. In U.S. Pat. No. 3,008,822, Nov. 14, 1961, the same inventors disclosed a low Si version of the same alloy with considerable improvement in machinability and weldability but at the expense of greatly reduced resistance to the hot, concentrated acid. It is marketed as Illium 98 for use in up to 98% sulfuric acid but is only used as a casting alloy.

More recently Yamaguchi, et al., U.S. Pat. No. 4,141,767, Feb. 1979, disclosed a two-phase stainless steel containing 10–75% ferrite and broad ranges of Ni and Cr. Yamaguchi also provides for optional Mo, Cu, Mn, Si and Cb contents as well as 0.06 to 6% Al.

Another problem with such alloys of the prior art is that the compositional ranges include extensive secondary or multiple matrix phases such as sigma, chi, alpha-prime and gamma-prime. There are many applications in which duplex alloys, of nearly equal matrix division between austenite and ferrite, provide excellent corrosion resistance. However, hot, concentrated sulfuric acid is not one of those situations.

Abo, et al. U.S. Pat. No. 4,172,716, Oct. 1979, also makes claim to broad element ranges for Ni, Cr and Mn in alloys said to resist pitting corrosion. Abo further provides for 0.1 to 6% Si, which is equivalent to making the Si content optional, inasmuch as it is virtually impossible to produce such alloys by ordinary means and with raw materials that would result in less than 0.1% Si. In similar manner, Abo's range of Mo of from 0.01 to 6% amounts to an optional content of this element. One or both of the elements Cu (0.1 to 4%) and Cb (0.1 to 2%) may be optionally includes. A similar Japanese patent, 58-210157, issued Dec. 7, 1983 and assigned to Sumimoto Metal Ind. discloses an alloy for oil-well piping and has broad ranges for Ni,Cr, Cu, Cb and Mo plus ½ W of 1.5% to 4%. It also provides for 0.10 to 0.25% C and 0–1% Si.

The patnet to Kudo, et al., U.S. Pat. No. 4,400,349, Aug. 1983, similarly discloses alloys for oil-well casing, tubing and pipes with broad ranges of Ni, Cr and Mn but require less than 1% Si and provide optionally for 0 to 12% Mo and 0 to 2% Cu.

Other prior art wrought metals and alloys also have severe limitations with respect to handling hot, concentrated sulfuric acid. Zirconium metal is available in all wrought forms but quite expensive and only suitable in hot sulfuric acid concentrations below 65–70%. Unalloyed tantalum has resistance to sulfuric acid solutions over the entire range of concentrations up to about 98% acid strength and temperatures up to about 230° C. However, tantalum is extremely scarce and expensive.

Ordinary carbon steel has long been used in handling sulfuric acid at ambient temperatures in the concentration range of 65–100% under static and low-velocity conditions. At temperatures above 25° C., however, attack by the acid may become erratic and catastrophic.

At ambient temperatures, austenitic stainless steels, for example type 304, exhibit passivity in sulfuric acid above 93% concentration. Mo extends the passive region to as low as 90% at ambient temperatures. At higher temperatures passivity is extended to concentrations above about 98.5–99%. Nevertheless, care must be taken when using stainless steels in the 98% to 100% concentrations at high temperatures; velocity conditions, reductions in acid concentration, or change in oxidant levels may initiate very high corrosion rates.

Austenitic high Si stainless steels have recently been developed that provide remarkable resistance to nitric acid above 95%. The cast version has a typical composition of Fe—21% Cr—16% Ni—5% Si—0.02% C. The wrought version of this alloy, designated A-711, has a typical composition of Fe—18% Cr—18% Ni—5.3% Si—0.02% C. The A-611 alloy also has useful corrosion resistance to 99% sulfuric acid up to 120° C.

In spite of all these efforts there still remains a need for alloys which not only have good resistance to hot concentrated sulfuric acid but which also have good ductility allowing them to be used in the manufacture of various items of commerce where wrought alloys are required.

SUMMARY OF THE INVENTION

It is therefore an object of this invention to provide alloys which have resistance to hot, concentrated sulfuric acid superior to that of prior art wrought metallic alloys. An additional object is to provide alloys having corrosion resistance superior even to prior casting alloys for hot acid above 96% acid. It is a further object to provide alloys with low strategic element contents and iron contents from about 36 to about 53%, which have fully austenitic matrices, low hardness and high ductility, weldability, workability, castabiility and machinability, are nonmagnetic even after hot or cold working, are capable of being readily cast or wrought into all possible shapes forms, such as tubes, plates and wire, and which are air-meltable and weldable. Yet another object is to provide alloys which are immune to sea water and totally resistant to local corrosion and stress corrosion cracking in chloride as encountered in sea water or similar solutions.

According to this invention alloys are provided which consist essentially by weight percentages of from about 19% to about 30% by weight Ni, from about 19% to about 27% by weight Cr, from about 0.3% to about 1.0% by weight Mo, from about 2.7% to 4.5% by weight Cu, from about 2.7% to about 4.7% by weight Mn, from about 2.45% to about 5.5% by weight Si, from about up to about 0.08% C by weight, and the balance essentially iron. The alloys may optionally contain up to 0.7% Cb partially replaced by up to 1% Ta, up to 0.6% W, up to 0.12% N and up to 0.8% Co, all by weight.

DETAILED DESCRIPTION OF THE INVENTION

The present invention is directed to alloys suitable for the manufacture of production, handling and storage equipment resistant to cold to very hot sulfuric acid in concentrations up to 98% or higher.

The components of the alloys of the invention are:

| | |
|---|---|
| Nickel | 19–30% by weight |
| Chromium | 19–27% |
| Molybdenum | 0.3–1% |
| Copper | 2.7–4.5% |
| Silicon | 2.4–5.5% |
| Manganese | 2.7–4.7% |

Normally the alloys of the invention will also contain carbon, up to a maximum of about 0.08% by weight.

Optionally, the alloys of the invention may further contain:

Columbium (Niobium) up to 0.7%

Tantalum up to 1% substituted for part of Cb at rate of 1% Ta =0.5% Cb, that is, the proportion of Cb and the proportion of Ta is limited by the expression 2(%Cb) +%Ta 1.4%.

Tungsten up to 0.6%

Nitrogen up to 0.12%

Cobalt up to 0.8 % as a part of the Ni content

The alloys of the present invention achieve resistance which is superior in hot 98% sulfuric acid to that of commercial alloys, such as Illium B or Illium 98, but which at the same time remain tough, soft and ductile so that they may be readily wrought into all shapes. Moreover, the properties of the instant alloys have been achieved at a strategic metal (Ni, Cr, Mo, Cu, Cb (Nb), Ta, etc.) content cost of approximately one-third that of those two alloys.

The relative cost indices of various elements are as follows:

| | |
|---|---|
| Columbium | 67 |
| Nickel | 33 |
| Molybdenum | 21 |
| Chromium | 16 or 7 |
| Copper | 5 |
| Silicon | 3 |
| Manganese | 1.2 |
| Iron | 1 |

These indices in fact indicate the relative scarcities and availabilities of the concerned elements in the known world supplies. While Cb is sometimes found in sulfuric acid resistant alloys in farily small proportions, Ni and Mo are still somewhat scarce elements. Chromium is given two index values in the above table because stainless steels and alloys of the present invention may be formulated from the lower cost ferro chromium raw material, while Ni-base alloys must be formulated from the much more expensive pure chromium metal. Copper is somewhat more plentiful, while Si is found worldwide as sand, silica or in silicates.

While manganese is not as plentiful as Si, its production technology has been established for decades which accounts for a rating lower than Si. The iron index of unity in the above table actually represents a premium, very high purity source of iron suitable for the best stainless steels and similar alloys. Much lower cost grades of steels are available as raw materials but would have to be purified for use in the instant alloys. The cost of such purification or refinement would bring their final costs up to about the unit figure of the above table.

The alloys of this invention with their high Cr, Mn and Si levels require no additional deoxidizers for melt cleanliness such as may be employed in steelmaking practices for other alloys. One such element is Al, which is neither required nor desirable in these alloys because of its tendency in some concentration ranges to form embrittling rock candy structures or oxide inclusions. Calcium is more readily oxidized in air melting than is Al, and is neither required nor beneficial here, although very small amounts can be tolerated.

Theoretically Ce, La or other rare earth elements could be employed in some steelmaking procedures as deoxidizers, but they have been noted for decades more for their ability to increase hot or cold workability. However, they are not required in the alloys of this invention for that purpose, and they have not been found to provide any measurable improvement in corrosion resistance. Therefore, such elements are not added intentionally, though they would not be deleterious in the small amounts that might be encountered in some scrap remelt situations.

Tungsten is permissible in the alloys of this invention up to about 0.6% and does appear to augment corrosion resistance in a few situations apart from the primary service in hot, concentrated sulfuric acid for which W is not required. In addition, it has been found that substitution with W in amounts up to about 5% W does not allow the Mo content to be completely eliminated in alloys of this invention. The use of above about 3% W results in very hard alloys of almost no ductility.

Cobalt has been employed in some corrosion resistant alloys, often as a deliberate substitute for some or all of the Ni that might otherwise have been employed. however, Co oftentimes has more of a hardening effect than Ni, and is not desirable in the instant alloys. However, certain Ni ore deposits contain small amounts of Co of the order of 2.5% of the refined Ni content. Co is chemically a sister element of Ni and therefore usually not intentionally removed at considerable additional expense except for certain atomic applications. Its presence in the Ni of the alloys of the present invention in the amounts as naturally occur is allowable, into detrimental, and merely considered to be a part of the Ni content.

While Cb is an optional addition element, it can not be used as a substitute for Cu, and indeed, Cu is essential to the present invention.

It should also be noted that S and Se are to be avoided. S should be held to about the usual 0.05% maximum of ordinary stainless steels because in higher amounts it causes hot shortness; that is, a tendency to crack during welding and in hot forming operations. Small amounts of sulfur of even 0.25%–0.40% cause rust streaks and general acceleration of attack in hot, concentrated sulfuric acid. Se has a very similar effect and is also avoided in the alloys of this invention.

The high Si contents of the alloys of this invention serve to greatly enhance machinability, probably because high Si tends to break up the machining chips. At about 50° to 90° C. in sulfuric acid strengths of 90% to 98%, alloys with Si contents less than 1% display corrosive attack of about 2 to 5 times that of the alloys of the present invention. At these acid strengths in the 100° to 220° C. range, corrosive attack of the low Si alloys varies from about 10 to 100 times that of the alloys of the invention.

It is noted that there are many other patents such as Rossomme, U.S. Pat. No. 4,421,557, and Baumel, U.S. Pat. No. 3,726,668, also disclose broad ranges of some of the elements of this invention but which contain proportions of Mo over 3%, which have been found to drastically harden and embrittle alloys of this invention.

Furthermore, the alloys of the prior art that may appear to have compositions similar to this invention do not in fact provide the outstanding resistance to hot, concentrated sulfuric acid as do the instant alloys because they depart from this invention in one or more important ways. The alloys of this invention, even after hot or cold working, always have a stable, single-phase, austenitic matrix, which is essential to corrosion resistance as well as fabricability. Microscopic metallographic examination of the new alloys also shows no grain boundary precipitates of carbides or nitrides or precipitates of any other kind. Further evidence of the stability of the structure of the alloys of this invention was obtained by adding small amounts of carbon and nitrogen to several alloy compositions along with columbium and thereafter analyzing the alloys for the presence of carbides and nitrides. In those tests a very small amount of carbides/nitrides of columbium were observed within the grains of the instant alloys. However, no precipitate of carbide or nitride was observed at the grain bounderies. Normally, carbon content will be easily held to 0.05 or 0.03% maximum and no Cb will be intentionally added. The alloys of this invention may also contain small amounts of silicon-rich precipitates, when Si levels are to the high side of the allowable range. However, these have not proven to be detrimental to the corrosion or mechanical properties of the alloys.

While carbon and nitrogen are both powerful austenite formers, they also form carbides and nitrides in the prior art alloys and have a hardening effect. On the other hand, the alloys of this invention remain soft, ductile and very fabricable despite their high Si contents due to the fact that the other constituent elements are proportioned to minimize hardening. It is therefore desirable that C, N and B not be deliberately increased. However, small amounts of these elements and of others may be tolerated as impurities. It is even desirable to minimize Cb content, and therefore this element is deliberately excluded as an intentional addition in the role of carbide stabilization and carbon itself is held to levels under 0.05% or even 0.03% when maximum fabricability is sought. Tantalum might be employed as a partial substitute for Cb when such additions are desired to stabilize slightly higher carbon contents.

Titanium is often employed as a carbide stabilizer in place of Cb or Ta. However, it is a light element and more difficult to shield from oxidation in ordinary air melting or steelmaking processes that do not employ vacuum or special atmospheres. While Ti additions are sometimes made to alloys in proportions which allow for some burning or oxidation during air melting, the recovery of Ti when such apractice is followed can be erratic, sometimes resulting in retained excess Ti or compounds of Ti, neither of which is desirable in alloys designed for easy fabrication.

Therefore, Ti is not employed as an optional carbide stabilizer and it is recommended that its content be held to about 0.25% or less as may be incurred as a tramp element in scraps.

Preferable alloys of this invention are therefore those having elements in the following ranges of proportions:

| | |
|---|---|
| Nickel (plus Cobalt) | 20–29% |
| Chromium | 20–26% |
| Molybdenum | 0.3–0.95% |
| Copper | 2.7–4.2% |
| Manganese | 2.7–4.0% |
| Silicon | 2.45–5.0% |
| Carbon | 0–0.05% |
| Columbium | 0–0.7% |
| Nitrogen | 0–0.12% |
| Tungsten | 0–0.6% |
| Iron | Essentially balance |

For good balance between mechanical and corrosion properties, it has been found desirable to further restrict the alloys of the invention to the following ranges of proportions:

| | |
|---|---|
| Nickel (plus Cobalt) | 20–25.5% |
| Chromium | 20–25.5% |
| Molybdenum | 0.3–0.7% |
| Copper | 2.75–3.6% |
| Manganese | 2.7–4.1% |
| Silicon | 2.45–4.85% |
| Carbon | 0–0.05% |
| Columbium | 0–0.65% |
| Nitrogen | 0–0.08% |
| Tungsten | 0–0.35% |
| Iron | Essentially balance |

A particularly advantageous alloy having maximum ductility, tensile elongation and workability coupled with lowest hardness, good resistance to strong sulfuric acid solutions from 20° to 110° C., and useful resistance from 20° C. to 130° C. has the following composition:

| | |
|---|---|
| Nickel | 20.5% |
| Chromium | 20.5% |
| Molybdenum | 0.45% |
| Copper | 3% |
| Manganese | 4% |
| Silicon | 3% |
| Carbon | 0.03% |
| Iron | Essentially balance |

An advantageous alloy having very good fabricability, tensile elongation, workability and low hardness along with useful resistance to strong sulfuric acid solutions from 20° C. to 225° C., and optimum resistance to hot sulfuric acid of greater than 93% concentration at temperatures over 140° C. and at least to 225° C. has the following composition:

| | |
|---|---|
| Nickel | 20.5% |
| Chromium | 24% |
| Molybdenum | 0.35% |

-continued

| | |
|---|---|
| Copper | 3.5% |
| Manganese | 3.5% |
| Silicon | 2.5% |
| Carbon | 0.03% |
| Columbium | 0.6% |
| Iron | Essentially balance |

An alloy having especially good galling resistance but very good fabricability along with useful resistance to strong sulfurc acid solutions from 20° C. to 150° C. and optimum resistance from 20° to 135° C., exceeding even that of the extremely brittle prior art casting alloys containing 6% to 6.5% Si or more, has the following composition:

| | |
|---|---|
| Nickel | 25% |
| Chromium | 20% |
| Molybdenum | 0.55% |
| Copper | 2.80% |
| Manganese | 2.75% |
| Silicon | 4.85% |
| Carbon | 0.03% |
| Columbium | 0.35% |
| Tungsten | 0.30% |
| Iron | Essentially balance |

A further particularly advantageous alloy which still retains fairly good fabricability, low hardness, machinability and ductility along with useful resistance from 20° C. to 225° C., but particularly good resistance to strong acid solutions at from 20° to 130° C., has the following composition:

| | |
|---|---|
| Nickel | 24% |
| Chromium | 25% |
| Molybdenum | 0.55% |
| Copper | 3.5% |
| Manganese | 4.0% |
| Silicon | 3.0% |
| Carbon | 0.03% |
| Iron | Essentially balance |

In all the alloy compositions of this invention it is to be understood that the iron content can include small amounts of tramp impurities.

The followng examples illustrate the invention.

EXAMPLE 1

One hundred pound heats of several different alloys were prepared in accordance with the invention. Each of the heats was air-melted in a 100-pound high frequency induction furnace. The compositions of these alloys is set forth in Table 1, with the balance in each instance being essentially iron.

TABLE I

| | PERCENT BY WEIGHT OF ALLOYING ELEMENTS* | | | | | | | | |
|---|---|---|---|---|---|---|---|---|---|
| ALLOY NUMBER | Ni | Cr | Mo | Cu | Mn | Si | Cb | C | W |
| 1459 | 20.32 | 20.55 | 0.45 | 3.03 | 4.02 | 3.02 | 0.01 | 0.00 | — |
| 1460 | 20.58 | 24.06 | 0.33 | 3.54 | 3.61 | 2.47 | 0.63 | 0.02 | — |
| 1461 | 24.04 | 24.88 | 0.55 | 3.53 | 4.04 | 3.49 | 0.62 | 0.00 | — |
| 1462 | 26.95 | 24.03 | 0.99 | 3.13 | 3.68 | 4.25 | 0.43 | 0.01 | 0.31 |
| 1463 | 24.67 | 20.15 | 0.53 | 2.78 | 2.75 | 4.85 | 0.36 | 0.01 | 0.32 |
| 1464 | 20.21 | 22.25 | 0.39 | 3.49 | 3.78 | 2.73 | — | 0.02 | — |
| 1465 | 22.06 | 23.03 | 0.77 | 3.51 | 3.83 | 2.62 | — | 0.05 | — |

*In each alloy iron is essentially the balance of the alloying elements

Standard physical test blocks and corrosion test bars were prepared from each heat. Using the cast physical thest blocks, the mechanical properties of each of these alloys were measured. Some were tested in the as cast condition while others were alternatively tested after a heat treatment of holding two hours at 2000° F. followed by still air cooling to room temperature. The results of these tests are set forth in Table II, with the heat treated examples noted by "HT".

TABLE II

PHYSICAL PROPERTIES OF ALLOYS OF THE INVENTION

| ALLOY NUMBER | TENSILE STRENGTH P.S.I. | YIELD STRENGTH P.S.I. | TENSILE ELONGATION | BRINELL HARDNESS NUMBER |
|---|---|---|---|---|
| 1459 | 65,500 | 23,800 | 57.5% | 107 |
| 1460 (HT) | 63,800 | 29,300 | 33.0% | 117 |
| 1461 (HT) | 62,800 | 30,400 | 28.5% | 133 |
| 1462 (HT) | 62,400 | 30,900 | 27.2% | 139 |
| 1463 (HT) | 63,100 | 30,600 | 29.0% | 140 |
| 1464 | 64,100 | 25,200 | 39.0% | 115 |
| 1465 | 61,400 | 25,200 | 38.0% | 116 |

These alloys were also tested for magnetic permeability and all alloys measured less than 1.01 gausses per oersted; that is, they had no measurable magnetic permeability.

The corrosion test bars were machined into $1\frac{1}{2}$-inch diameter by $\frac{1}{4}$-inch thick discs, each having a $\frac{1}{8}$-inch diameter hole in the center. These discs were carefully machines and then ground to a 240-grit finish and polished to a 600-grit finish. These discs were then used in various corrosion tests, described herein.

The corrosion rate, in mils per year, was calculated in accordance with the formula:

$$R_{mpy} = 393.7 \frac{W_o - W_f}{ATD}$$

where $R_{mpy}$=corrosion rate in mils per year $W_o$=original weight of sample in grams $W_f$=final weight of sample in grams A=area of sample in square cm T=duration of test in years D=density of alloy in gm/cc In the corrosion data, the units employed to express the corrosion depth are mils. One mil equals 0.001 inch. The rate of corrosion attach is expressed in mils per year, M.P.Y. Rates of attack of 20 M.P.Y. or even 30 M.P.Y. have been tolerated in some situations involving the handling of hot, concentrated sulfuric acid, but a rate of 10 M.P.Y. or less is much more often required for service in many situations, particularly involving the production, storage and transportation of the original acid.

EXAMPLE 2

Although the alloys of this invention were not specifically developed for salt water service, my prior work in this field indicated that they should resist sea water attack. Accordingly, discs from each heat were placed in plastic containers with one face of each disc flat on the container bottom and under a layer of sea water of a depth of about $1\frac{3}{4}$ inches. The sea water was taken from the Atlantic Ocean at Myrtle Beach, South Carolina. The sea water was held at room temperature in the plastic containers with tight-fitting lids to avoid evaporation. The sea water was replaced every two weeks at which time the bottoms of all discs were examined. The tops and edges of the discs were examined daily. A similar set of discs was placed in more of the same sea water to which had been added 30 drops of concentrated hydrochloric acid per gallon of sea water which resulted in a pH of 1.9 as measured by a pH meter set so that distilled water registered a pH of 7.0. It is thought that a higher acidity, or lower pH value, accelerates local attack. After 6 months there were no visible pits, rust spots or discolorations visible under a 10-power magnifying glass on any of the samples of alloys of this invention. Experience has shown that alloys of low resistance to sea water such as ordinary stainless steels, may show pits or rust spots within a few weeks, days or even hours.

EXAMPLE 3

Test discs of the alloys were suspended by platinum wires in 10%, 25%, and 40% sulfuric acid-water solutions at numerous temperatures ranging between 22° C. and 110° C. These test solutions are generally considered to be chemically reducing. While the alloys of the invention were developed to resist concentrated, or oxidizing, solutions of sulfuric acid, these tests demonstrate that they also possess useful resistance to reducing conditions. The temperatures at which corrosion rates for representative alloys in each solution reached 10 M.P.Y., 20 M.P.Y., and 30 M.P.Y. are set forthin Table III. Other alloys of the invention give essentially the same results. Test periods for each condition were 24 hours.

TABLE III

| ATTACK M.P.Y. | % $H_2SO_4$ | ALLOY 1459 | ALLOY 1465 |
|---|---|---|---|
| | 10% | 52° C. | 67° C. |
| 10 | 25% | 63° C. | 67° C. |
| | 40% | 83° C. | 67° C. |
| | 10% | 63° C. | 73° C. |
| 20 | 25% | 75° C. | 72° C. |
| | 40% | 94° C. | 78° C. |
| | 10% | 69° C. | 78° C. |
| 30 | 25% | 80° C. | 77° C. |
| | 40% | 101° C. | 84° C. |

EXAMPLE 4

Discs of alloys of the invention were suspended for 48-hour periods at various temperatures in 90%, 93%, 95%, 96%, 97% and 98% sulfuric acid. Discs of Illium 98, or 55% Ni—28% Cr—8.5% Mo—5.5% Cu—1.25% Mn—0.7% Si—1% Fe, and Illium B, or 52% Ni—28% Cr—8.5% Mo—5.5% Cu—1.25% Mn—3.5% Si—2% Fe—0.4% B, were also tested along with the alloys of the invention. Typical data is demonstraed by Alloy 1460 and set forth in Table IV along with the comparative alloys in terms of M.P.Y. attack at representative temperatures and acid strengths.

TABLE IV

| $H_2SO_4$ ACID STRENGTH | TEST TEMPERATURE | ALLOY 1460 | 3.5% Si ILLIUM B | ILLIUM 98 |
|---|---|---|---|---|
| 90% | 80° C. | 10.3 M.P.Y. | 0.2 M.P.Y. | 4.9 M.P.Y. |
| 93% | 90° C. | 10.1 | 0.5 | 8.1 |
| 95% | 100° C. | 8.0 | 6.5 | 17.2 |
| 96% | 110° C. | 8.7 | 9.7 | 21.2 |
| | 190° C. | 13.7 | 964 | 1380 |
| 97% | 120° C. | 10.0 | 21.1 | 36.2 |
| 98% | 130° C. | 9.6 | 34.3 | 67.2 |
| | 140° C. | 12.1 | 87 | 147.1 |
| | 150° C. | 11.5 | 157 | 235 |
| | 160° C. | 10.3 | 245 | 395 |
| | 170° C. | 8.8 | 404 | 622 |
| | 180° C. | 7.9 | 615 | 870 |
| | 190° C. | 7.6 | 833 | N.T. |
| | 200° C. | 8.7 | 1223 | N.T. |
| | 210° C. | 10.7 | 1622 | N.T. |
| | 220° C. | 13.9 | 2008 | N.T. |

N.T. = Not Tested

EXAMPLE 5

Alloys of the invention, such as No. 1460, which are so formulated that their Cr levels are on the higher side of the range, i.e., over 23% Cr, while their Si levels are on the lower side of the invention range, such as below about 3.5% Si, demonstrate the remarkable ability of these alloys to experience a reversal of corrosion attach rates in concentrated sulfuric acid solutions once the temperature reaches about 140° C. At this point attack rates drop slightly until temperatures reach about 190° C. and then slowly climb again. Variations of the alloys of the invention of the 1460 type show fairly steady attack rates from about 140° C. to about 220° C., while prior art Illium type alloys suffer ever increasing attack rates over these ranges of temperatures.

However, when the alloys of this invention are formulated more like No. 1463 with Cr levels around 20% and Si levels nearer the maximum, such as about 4.85%, they demonstrate lower attack rates than even the most brittle casting alloys, up to at least 150° C., and yet remain readily machined, forged, welded, etc.

These properties are demonstrated in Example 6 in which tests were conducted in hot 96.2% sulfuric acid of alloy No. 1463 of the present invention, Illium 98, the standard Illium B of 3.5% Si, and the glass-brittle special Illium B made with 6.5% Si.

EXAMPLE 6

Test discs of an alloy were pickled 5 hours in 35% nitric acid at 80° C. to remove any dust, cutting oil or foreign matter, rinsed in water and dried. Each cleaned disc was weighed to the nearest 10,000th of a gram and then suspended in a flask by a platinum wire hooked through the center hole of the disc and attached to the top of the flask. Sufficient sulfuric acid was then added to the beaker so that the disc was completely immersed in the acid and a fitted, water cooled sealed top was installed. The temperature of the acid was maintained at various temperatures from 80° C. to 150° C. by means of a hot plate.

The corrosion tests were conducted for 36 hours; however, every six hours the test discs were moved to different flasks containing fresh acid which had been brought to the desired temperature. After 36 hours, the discs were removed from the sulfuric acid and cleaned of corrosion products. Most samples were cleaned sufficiently with a nylon brush and tap water. Samples on which the corrosion products were too heavy for removal with the brush were cleaned with a 1:1 solution of hydrochloric acid and water. After the corrosion products had been removed, each disc was dried and weighed again to the nearest 10,000th of a gram. The results of these tests are set forth in Table V.

TABLE V

ATTACK IN MILS PER YEAR IN 96.2% SULFURIC ACID AT VARIOUS TEMPERATURES

| TEST TEMPERATURES | NO. 1463 | ILLIUM 98 | 3.5% Si ILLIUM B | 6.5% Si ILLIUM B |
|---|---|---|---|---|
| 80° C. | 0.1 | 3.6 | 1.1 | 0.4 |
| 90° C. | 0.3 | 7.5 | 2.4 | 0.6 |
| 100° C. | 0.6 | 14.6 | 4.8 | 0.9 |
| 110° C. | 0.9 | 27.6 | 9.7 | 2.0 |
| 120° C. | 2.6 | 45.3 | 17.7 | 5.6 |
| 130° C. | 6.5 | 83.2 | 30.3 | 14.1 |
| 140° C. | 13.9 | 207.2 | 50.8 | 28.2 |
| 150° C. | 25.3 | 249.6 | 71.6 | 51.5 |

In view of the above, it will be seen that the several objects of the inventions are achieved and other advantageous results attained.

As various changes could be made in the above processes without departing from the scope of the invention, it is intended that all matter contained in the above description shall be interpreted as illustrative and not in a limiting sense.

What is claimed is:

1. An alloy consisting essentially of

| | |
|---|---|
| Nickel | 19–30% by weight |
| Chromium | 19–27% |
| Molybdenum | 0.3–1% |
| Copper | 2.7–4.5% |
| Manganese | 2.7–4.7% |
| Silicon | 2.7–5.5% |
| Carbon | up to about 0.08% |
| Columbium | up to about 0.7% |
| Tantalum | up to about 1% substituted for part of Cb at the rate of 1% Ta = 0.5% Cb |
| Nitrogen | up to about 0.12% |
| Tungsten | up to about 0.6% |
| Cobalt | up to about 0.8% |
| Iron | essentially balance |

2. An alloy of claim 1 containing

| | |
|---|---|
| Nickel | 27.0% |
| Chromium | 24.0% |
| Molybdenum | 0.99% |
| Copper | 3.1% |
| Manganese | 3.7% |
| Silicon | 4.3% |
| Carbon | 0.01% |
| Columbium | 0.43% |
| Tungsten | 0.31% |
| Iron | essentially balance |

3. An alloy of claim 1, consisting essentially of

| | |
|---|---|
| Nickel (including Cobalt) | 20–29% |
| Chromium | 20–26% |
| Molybdenum | 0.3–0.95% |
| Copper | 2.7–4.2% |
| Manganese | 2.7–4.1% |
| Silicon | 2.45–5.0% |
| Carbon | 0–0.05% |
| Columbium | 0–0.7% |
| Nitrogen | 0–0.12% |
| Tungsten | 0–0.6% |
| Iron | essentially balance |

4. An alloy of claim 3, consisting essentially of

| | |
|---|---|
| Nickel (including Cobalt) | 20–14 25.5% |
| Chromium | 20–25.5% |
| Molybdenum | 0.3–0.7% |
| Copper | 2.75–3.6% |
| Manganese | 2.7–4.1% |
| Silicon | 2.45–4.85% |
| Carbon | 0–0.05% |
| Columbium | 0–0.65% |
| Nitrogen | 0–0.08% |
| Tungsten | 0–0.35% |
| Iron | essentially balance |

5. An alloy of claim 3 containing

| | |
|---|---|
| Nickel | 24.7% |
| Chromium | 20.2% |
| Molybdenum | 0.53% |
| Copper | 2.8% |
| Manganese | 2.8% |
| Silicon | 4.9% |
| Carbon | 0.01% |
| Columbium | 0.36% |
| Tungsten | 0.32% |
| Iron | essentially balance |

6. An alloy of claim 4 containing

| | |
|---|---|
| Nickel | 25% |
| Chromium | 20% |
| Molybdenum | 0.55% |
| Copper | 2.80% |
| Manganese | 2.75% |
| Silicon | 4.85% |
| Carbon | 0.03% |
| Columbium | 0.35% |
| Tungsten | 0.30% |
| Iron | essentially balance |

7. An alloy of claim 3 containing

| | |
|---|---|
| Nickel | 22.1% |
| Chromium | 23.0% |
| Molybdenum | 0.77% |
| Copper | 3.5% |

-continued

| | |
|---|---|
| Manganese | 3.8% |
| Silicon | 2.6% |
| Carbon | 0.05% |
| Iron | essentially balance |

8. An alloy of claim 4 containing

| | |
|---|---|
| Nickel | 20.3% |
| Chromium | 20.6% |
| Molybdenum | 0.45% |
| Copper | 3% |
| Manganese | 4% |
| Silicon | 3% |
| Columbium | 0.01% |
| Iron | essentially balance |

9. An alloy of claim 4 containing

| | |
|---|---|
| Nickel | 20.5% |
| Chromium | 20.5% |
| Molybdenum | 0.45% |
| Copper | 3% |
| Manganese | 4% |
| Silicon | 3% |
| Carbon | 0.03% |
| Iron | essentially balance |

10. An alloy of claim 4 containing

| | |
|---|---|
| Nickel | 20.6% |
| Chromium | 24.1% |
| Molybdenum | 0.33% |
| Copper | 3.5% |
| Manganese | 3.6% |
| Silicon | 2.5% |
| Carbon | 0.02% |
| Columbium | 0.63% |
| Iron | essentially balance |

11. An alloy of claim 4 containing

| | |
|---|---|
| Nickel | 20.5% |
| Chromium | 24% |
| Molybdenum | 0.35% |
| Copper | 3.5% |
| Manganese | 3.5% |
| Silicon | 2.5% |
| Carbon | 0.03% |
| Columbium | 0.06% |
| Iron | essentially balance |

12. An alloy of claim 4 containing

| | |
|---|---|
| Nickel | 24.70% |
| Chromium | 24.9% |
| Molybdenum | 0.55% |
| Copper | 3.5% |
| Manganese | 4.0% |
| Silicon | 3.5% |
| Columbium | 0.62% |
| Iron | essentially balance |

13. An alloy of claim 4 containing

| | |
|---|---|
| Nickel | 24% |
| Chromium | 25% |
| Molybdenum | 0.55% |
| Copper | 3.5% |
| Manganese | 4.0% |

-continued

| | |
|---|---|
| Silicon | 3.0% |
| Carbon | 0.03% |
| Iron | essentially balance |

14. An alloy of claim 4 containing

| | |
|---|---|
| Nickel | 20.2% |
| Chromium | 22.3% |
| Molybdenum | 0.39% |
| Copper | 3.5% |
| Manganese | 3.8% |
| Silicon | 2.7% |
| Carbon | 0.02% |
| Iron | essentially balance |

* * * * *

UNITED STATES PATENT AND TRADEMARK OFFICE

CERTIFICATE OF CORRECTION

PATENT NO. : 4,873,055

DATED : October 10, 1989

INVENTOR(S) : John H. Culling

It is certified that error appears in the above-identified patent and that said Letters Patent is hereby corrected as shown below:

Column 3, line 39, "designated A-711", should read ---designated A-611---.

Column 1, line 52, "acid to today's", should read ---acid by today's---.

Column 2, line 67, "be optionally includes", should read ---be optionally included---.

Column 5, line 48, "employed. however", should read ---employed. However---.

Column 5, line 57, "allowable, into detrimental", should read ---allowable, not detrimental---.

Column 11, line 27, "corrosion attach", should read ---corrosion attack---.

UNITED STATES PATENT AND TRADEMARK OFFICE

CERTIFICATE OF CORRECTION

PATENT NO. : 4,873,055

DATED : October 10, 1989

INVENTOR(S) : John H. Culling

It is certified that error appears in the above-identified patent and that said Letters Patent is hereby corrected as shown below:

Column 13, line 28, "Nickel (including Cobalt) 20-14 25.5%", should read --Nickel (including Cobalt) 20-25.5%--.

Signed and Sealed this

First Day of January, 1991

*Attest:*

HARRY F. MANBECK, JR.

*Attesting Officer*

*Commissioner of Patents and Trademarks*